US008215207B2

(12) United States Patent
Huang

(10) Patent No.: US 8,215,207 B2
(45) Date of Patent: Jul. 10, 2012

(54) RATCHET WRENCH

(75) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 319 days.

(21) Appl. No.: 12/652,070

(22) Filed: Jan. 5, 2010

(65) Prior Publication Data

US 2011/0162489 A1 Jul. 7, 2011

(51) Int. Cl.
*B25B 13/46* (2006.01)

(52) U.S. Cl. ..... 81/63.1

(58) Field of Classification Search ..... 81/60–63.2
See application file for complete search history.

(56) References Cited

U.S. PATENT DOCUMENTS 2,201,705 A * 5/1940 Stone ..... 192/43.2
2,201,827 A * 5/1940 Froeschl et al. ..... 81/63.1
6,467,378 B1 * 10/2002 Chen ..... 81/60
6,966,241 B2 * 11/2005 Huang ..... 81/63.2
7,080,579 B2 * 7/2006 Chen ..... 81/63.1
7,313,987 B1 * 1/2008 Chen ..... 81/63.1
7,895,921 B2 * 3/2011 Huang ..... 81/63.1

* cited by examiner

*Primary Examiner* — Hadi Shakeri
(74) *Attorney, Agent, or Firm* — Alan Kamrath; Kamrath IP Lawfirm, PA

(57) ABSTRACT

A ratchet wrench includes a driving end including a ratchet member, two pawls releasably and selectively engaging with the ratchet member for setting the ratchet wrench in two operation modes, and a switching mechanism disposed between the pawls. The switching mechanism includes limits urging the respective pawls such that one limit engages with one pawl to urge it to disengage from the ratchet member while the other limit disengages from the other pawl to allow it to engage with the ratchet member in one operation mode, and the other limit engages with the other pawl to urge it to disengage from the ratchet member while the one limit disengages from the one pawl to allow it to engage with the ratchet member in another operation mode. Additionally, the pawls are prevented from being mis-shifted by the switching mechanism.

20 Claims, 11 Drawing Sheets

RATCHET WRENCH

BACKGROUND OF THE INVENTION

1. Field of the Invention

The present invention relates to a ratchet wrench and, in particular, to a ratchet wrench that has improved reliability.

2. Description of the Related Art

Generally, a ratchet wrench includes a driving end including a ratchet member and at least one pawl releasably engaging with the ratchet member for determining operational directions of the ratchet wrench. Each of the ratchet member and at least one pawl generally has a plurality of teeth formed thereon, and one of the plurality of teeth of the ratchet member engages between two adjacent teeth of the pawl upon engagement therebetween. However, the ratchet wrench sometimes suffers a teeth-engagement problem in that the at least one pawl is mis-shifted such that each tooth on the ratchet member is not appropriately engaged in two adjacent teeth of the pawl, and even worse, teeth breakage might happen due to this improper engagement.

The present invention is, therefore, intended to obviate or at least alleviate the problems encountered in the prior art.

SUMMARY OF THE INVENTION

According to the present invention, a ratchet wrench includes a driving end, a ratchet member rotatably received in the driving end, and two pawl mechanisms releasably engaging with the ratchet member. Each pawl mechanism can move toward and away from the ratchet member in a moving path. The ratchet wrench further includes a switching mechanism disposed between the pawl mechanisms. The switch mechanism includes a body including an urging section defining limits such that one limit engages with one pawl mechanism to urge it to disengage from the ratchet member while the other limit disengages from the other pawl mechanism to allow it to engage with the ratchet member in a first operation mode, and the other limit engages with the other pawl mechanism to urge it to disengage from the ratchet member while the one limit disengages from the one pawl mechanism to allow it to engage with the ratchet member in a second operation mode. The body further includes a holding section abutting both pawl mechanisms and preventing each of them from rotating about its moving path in order to limit the pawl mechanisms from mis-shifting.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
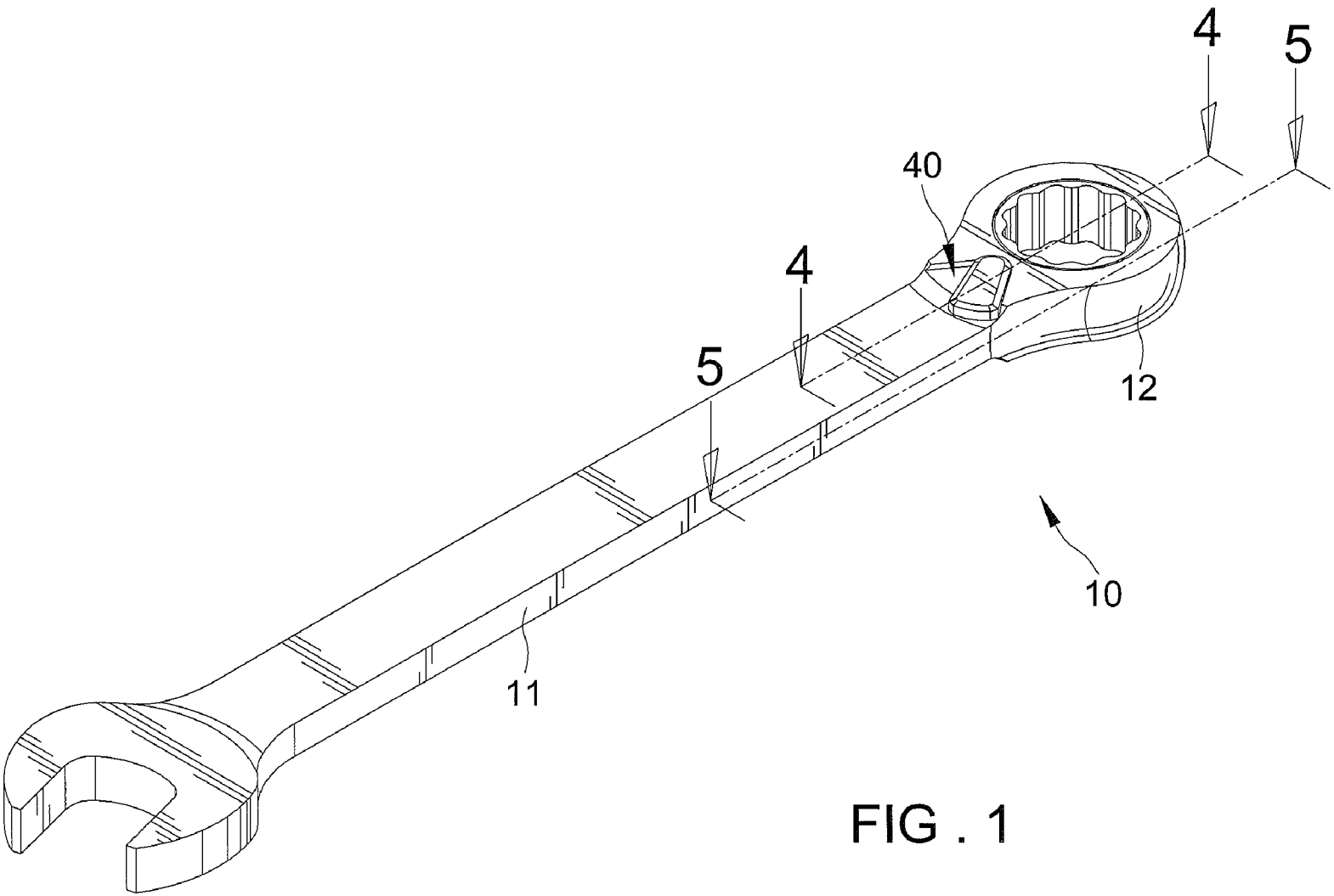
FIG. 1 is a perspective view of a ratchet wrench in accordance with the present invention.
Figure 2:
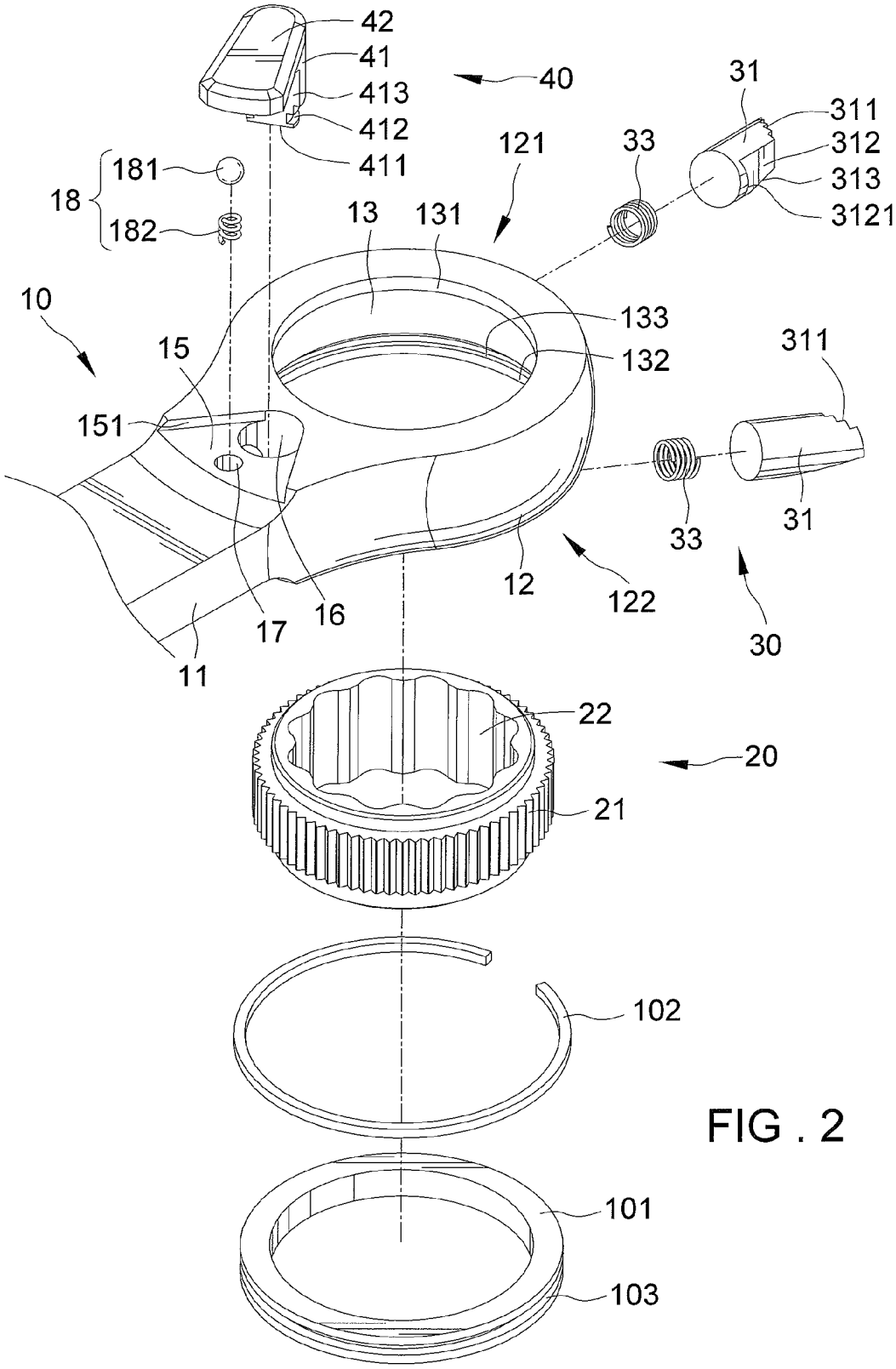
FIG. 2 is an exploded perspective view of the ratchet wrench embodying the present invention.
Figure 3:
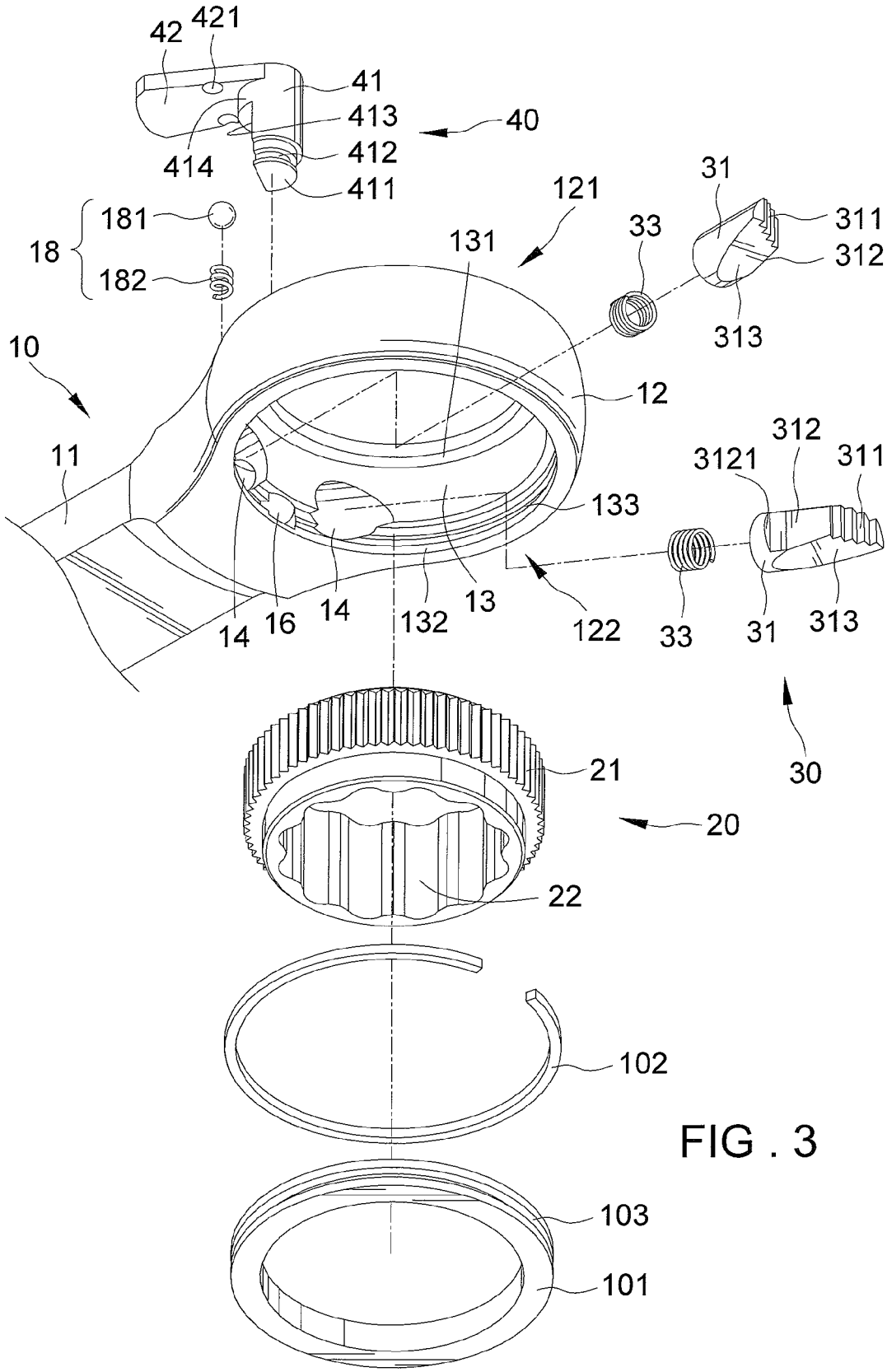
FIG. 3 is another exploded perspective view of the ratchet wrench embodying the present invention taken from a different angle of view.
Figure 4:
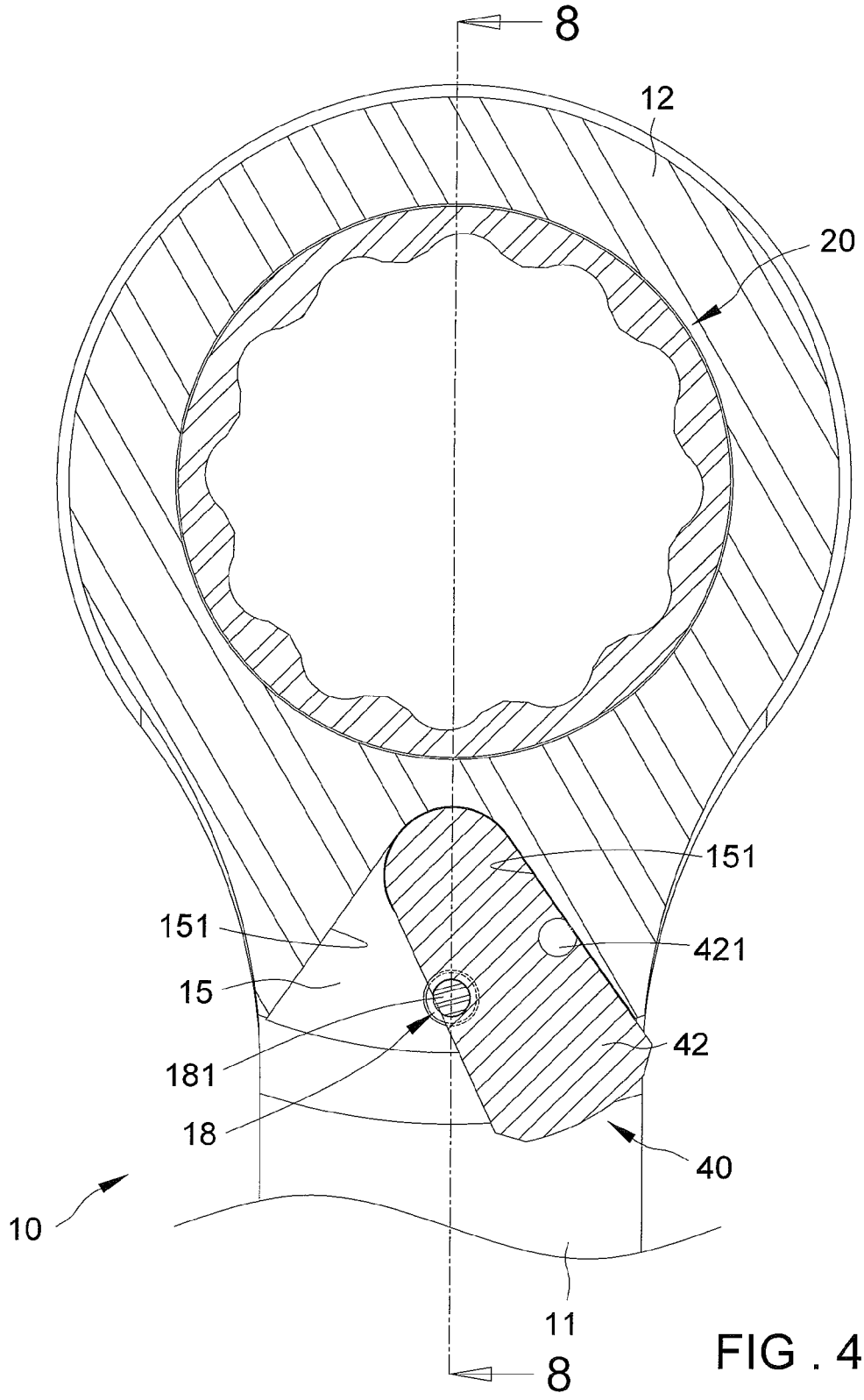
FIG. 4 is a cross-sectional view of the ratchet wrench embodying the present invention taken along line 4-4 of FIG. 1.

Referring to the drawings, a ratchet wrench 10 includes a handle 11 and a driving end 12. The driving end 12 is preferably disposed at a distal end of the handle 11 in order to obtain the most work-efficient condition. Therefore, when the ratchet wrench 10 is in use, the handle 11 is to be grasped by a user's hand, and the driving end 12 engages with a workpiece that is to be turned.

The driving end 12 includes two opposing sides including a first side 121 and a second side 122, and the first side 121 is spaced from the second side 122. In addition, the driving end 12 includes a compartment 13 extending therethrough from the first side 121 to the second side 122. The compartment 13 extends in a direction orthogonal to a direction that the handle 11 extends. Further, a ratchet member 20 is received in the compartment 13. The ratchet member 20 includes an orifice 22, and the workpiece can be inserted and retained therein. The orifice 22 extends through the ratchet member 20 and preferably has a polygonal cross section. Furthermore, the ratchet member 20 includes its inner peripheral edge delimiting the size of the orifice 22. Moreover, the ratchet member 20 includes its outer peripheral edge including a plurality of teeth 21 formed thereon. Each tooth 21 extends parallel to one another and in a direction as that of the orifice 22. Furthermore, the ratchet member 20 is prevented from disengagement from the compartment 13 by a flange 131 formed from the first side 121 of the driving end 12 and a retainer 101 which is insertably mounted in the compartment 13 after the ratchet member 20 is disposed in the compartment 13. Moreover, the compartment 13 includes a recess 132 in which the retainer 101 is fixed. The recess 132 extends annularly and is adjacent to the second side 122 of the driving end 12. Furthermore, the retainer 101 includes its outer peripheral edge having a groove 103 extending therealong, and the recess 132 includes a channel 133 formed theron. Further, a clip 102 includes its inner peripheral edge disposed in the groove 103 and its outer peripheral edge disposed in the channel 133 to fix the retainer 101 in the recess 132. In the embodiment, the retainer 101 is of a ring shape and has an enclosed circular cross section, and the clip 102 is of a ring shape and has an unenclosed circular cross section.

The driving end 12 further includes two cavities 14 extending therein and which are spaced from each other. Each cavity 14 extends orthogonally to the compartment 13. Also, each cavity 14 has a proximal end connected with the compartment 13 and is in communication with the compartment 13. In addition, each cavity 14 includes a distal end opposing to the proximal end and terminated in the driving end 12. Furthermore, the proximal end of each cavity 14 has a lower height with respect to the second side 122 of the driving end 12 than the distal end, so the cavity 14 includes a lateral wall having a cross section defining a slope.

Figure 5:
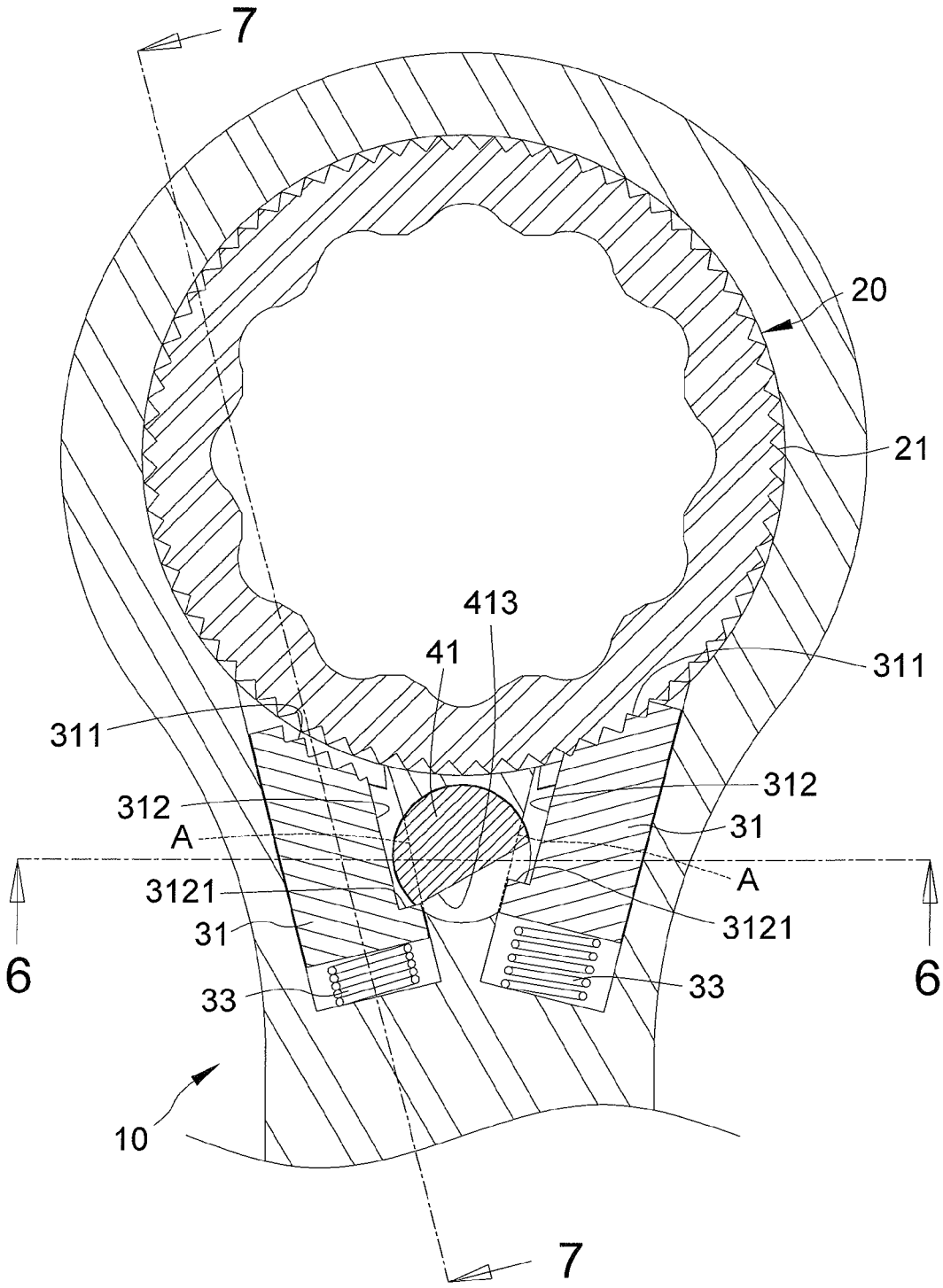
FIG. 5 is a cross-sectional view of the ratchet wrench embodying the present invention taken along line 5-5 of FIG. 1.
Figure 10:
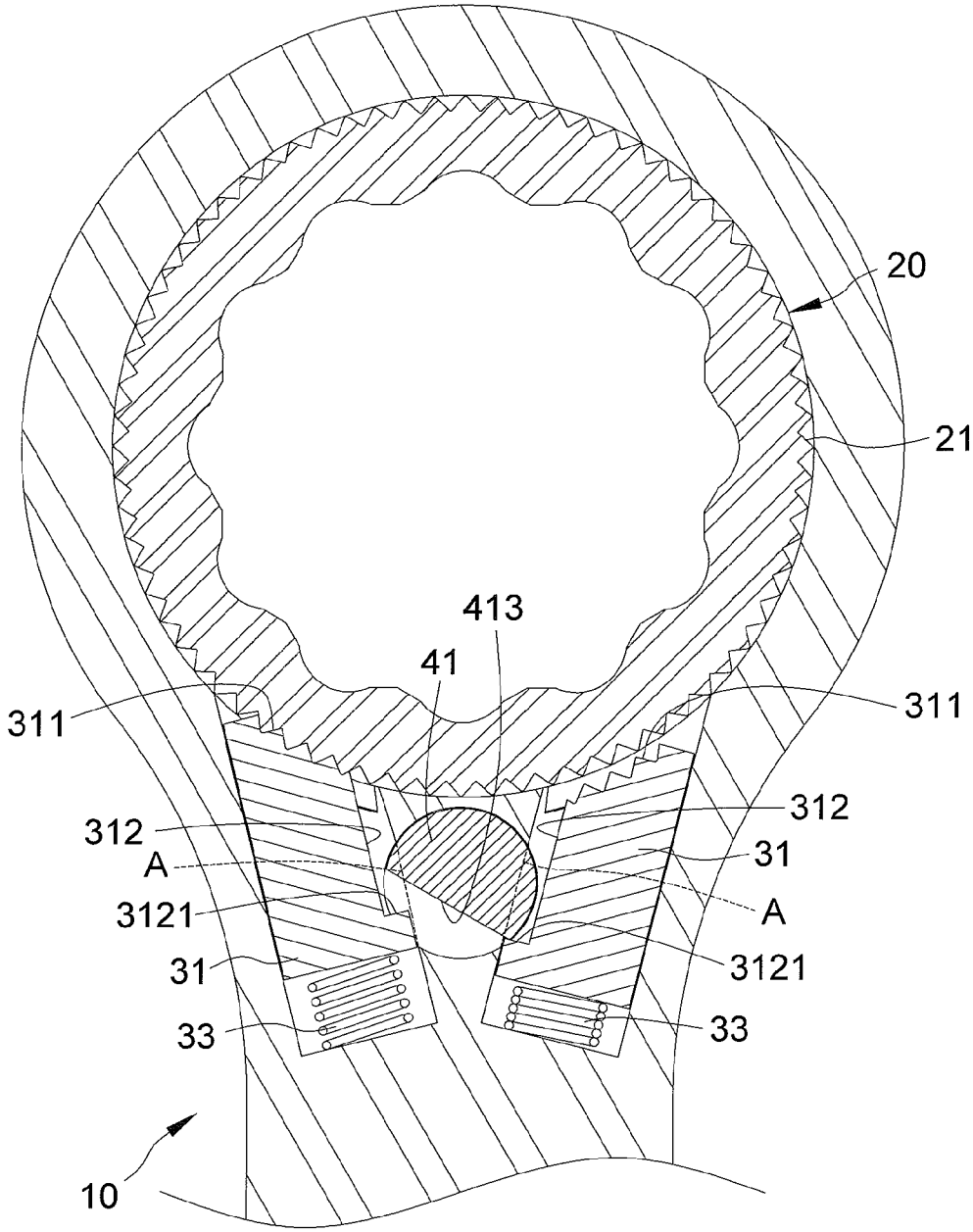
FIG. 10 is a cross-sectional view similar to FIG. 5 but shows the ratchet wrench set in the operation mode corresponding to FIG. 9.
Figure 11:
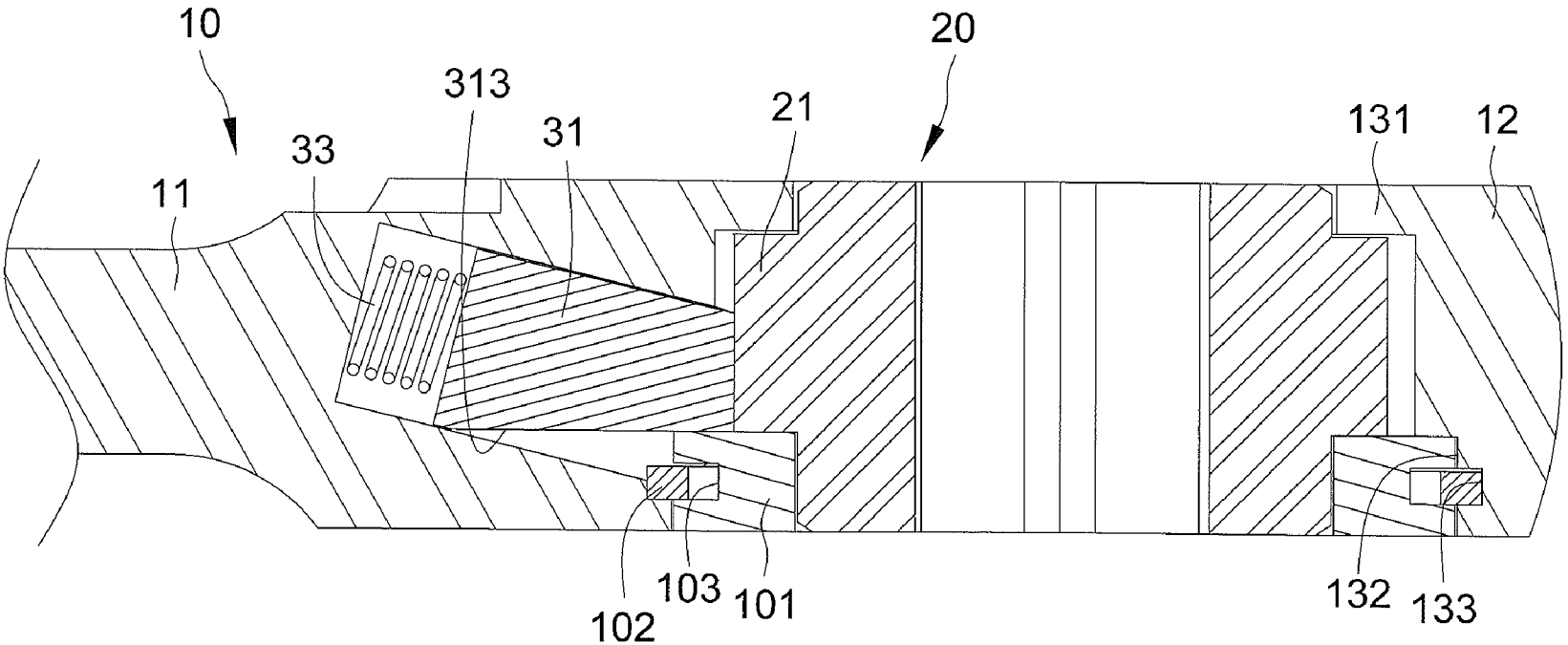
FIG. 11 is a cross-sectional view similar to FIG. 7 but shows the ratchet wrench set in the operation mode corresponding to FIG. 9.

The ratchet member 20 is rotatable in two directions, i.e. clockwise and anticlockwise directions, in the compartment 13 about its longitudinal axis. Furthermore, two pawl mechanisms 30 are received in the two cavities 14 respectively and alternatively engage with the ratchet member 20 and stop the ratchet member 20 from rotating in a direction that the ratchet wrench 10 is intended to be turned. As an example, FIG. 5 shows the ratchet member 20 engaged with one pawl mechanism 30, and the pawl mechanism 30 prevents the ratchet member 20 from rotating in the anticlockwise direction so the ratchet wrench 10 would be operated anticlockwise for turning the workpiece. Conversely, FIG. 10 shows the ratchet member 20 engaged with the other pawl mechanism 30, and the pawl mechanism 30 prevents the ratchet member 20 from rotating in the clockwise direction so the ratchet wrench 10 would be operated clockwise for turning the workpiece. Furthermore, each pawl mechanism 30 includes a pawl 31 having a proximal end with a plurality of teeth 311 formed thereon, and one of the teeth 311 of the pawl 31 would engage in two adjacent teeth 21 of the ratchet member 20 upon engagement of the pawl mechanism 30 with the ratchet member 20. In addition, each pawl mechanism 30 includes a resilient member 33 biasing the pawl 31, and the pawl 31 includes a distal end opposing to its proximal end abutted by one of two opposing ends of the resilient member 33. Furthermore, the other end of the resilient member 33 abuts against the distal end of the associated cavity 14.

The ratchet wrench 10 further includes a switching mechanism 40 moveably fixed on the driving end 12. The switching member includes a body 41 selectively urging the pawl 31 of one pawl mechanism 30 to disengage from the ratchet member 20 while allowing the pawl 31 of the other pawl mechanism 30 to engage with the ratchet member 20. As an example, FIG. 5 shows the pawl 31 of the pawl mechanism 30 disposed on the left is urged by the switching mechanism 40 to disengage it from the ratchet member 20, and the pawl 31 of the pawl mechanism 30 on the right is engaged with the ratchet member 20. Conversely, FIG. 10 shows the pawl 31 of the pawl mechanism 30 disposed on the right is urged by the switching mechanism 40 to disengage it from the ratchet member 20, and the pawl 31 of the pawl mechanism 30 on the left is engaged with the ratchet member 20. In addition, the body 41 is fixed in a hole 16 and is rotatable therein about its longitudinal axis. The hole 16 is connected with the cavities 14 and is in communication with the cavities 14. Also, the hole 16 and each cavity 14 include a common area "A" defined therebetween. The hole 16 further includes a terminating end connected with the compartment 13 and is in communication with the compartment 13. The terminating end of the hole 16 is superimposed on the channel 133 defined in the driving end 12. Furthermore, the clip 102 partially extends in the hole 16 to prevent the body 41 from disengagement from the hole 16. The body 41 includes a portion defining a retaining section 411 with a slot 412 formed thereon, and the clip 102 is partially engaged in the slot 412 to fix the body 41 in the hole 16.

In addition, the pawl 31 urged by the switching mechanism 40 would depress the associated elastic element 33. Furthermore, each of the pawls 31 is adapted to be biased to engage the ratchet member 20 by a resilient force of the associated elastic element 33 after the switching mechanism 40 is disengaged from the pawl 33. As a result, the resilient member 33 facilitates re-engagement of the associated pawl 31 with the ratchet member 20.

As set forth, the body 41 of the switching mechanism 40 selectively urges the pawl mechanisms 30 such that it disengages one of them from the ratchet member 20 while allowing the other to engage with the ratchet member 20. Specifically, the body 41 includes an urging section 413 including limits urging the respective pawls 31 such that one limit engages with one pawl 31 to urge it to disengage from the ratchet member 20 while the other limit disengages from the other pawl 31 to allow it to engage with the ratchet member 20 in one operation mode, and the other limit engages with the other pawl 31 to urge it to disengage from the ratchet member 20 while the one limit disengages from the one pawl 31 to allow it to engage with the ratchet member 20 in another operation mode. Also, the limits are defined at two opposing ends of the urging section 413. In addition, the urging section 413 is preferably a flat surface so that it is easy to manufacture and would be cost-saving. Furthermore, each pawl 31 includes a lateral side 312 extending in a first path from the proximal end to distal end and having a stopping section 3121 to be urged by the associated limit, to thereby disengage the pawl 31 from the ratchet member 20. The stopping section 3121 extends in a second path crossing the first path. Also, the lateral side 312 is preferably defined by a flat surface so that it is easy to manufacture and would be cost-saving.

Figure 6:
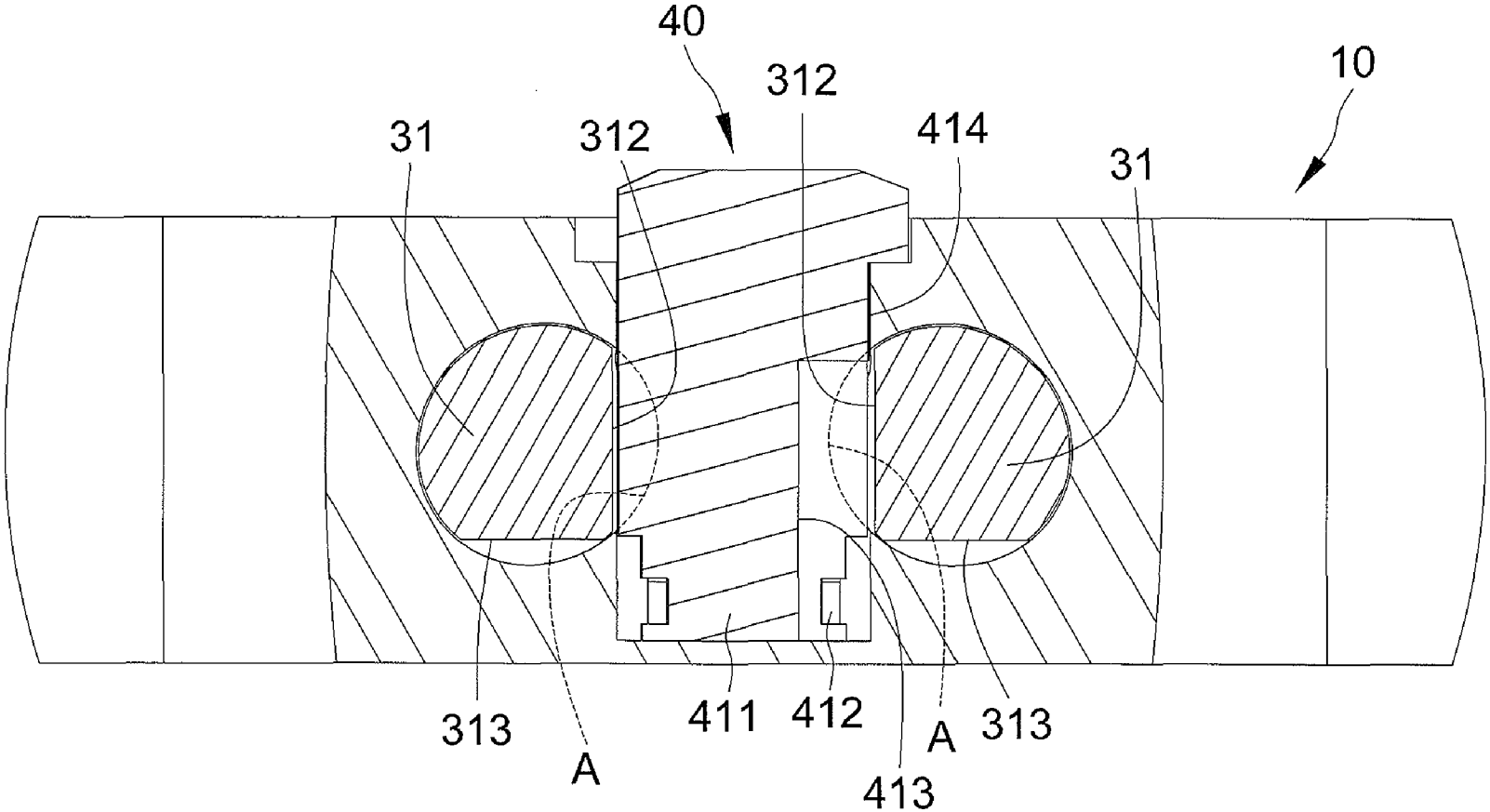
FIG. 6 is a cross-sectional view of the ratchet wrench embodying the present invention taken along line 6-6 of FIG. 5.
Figure 7:
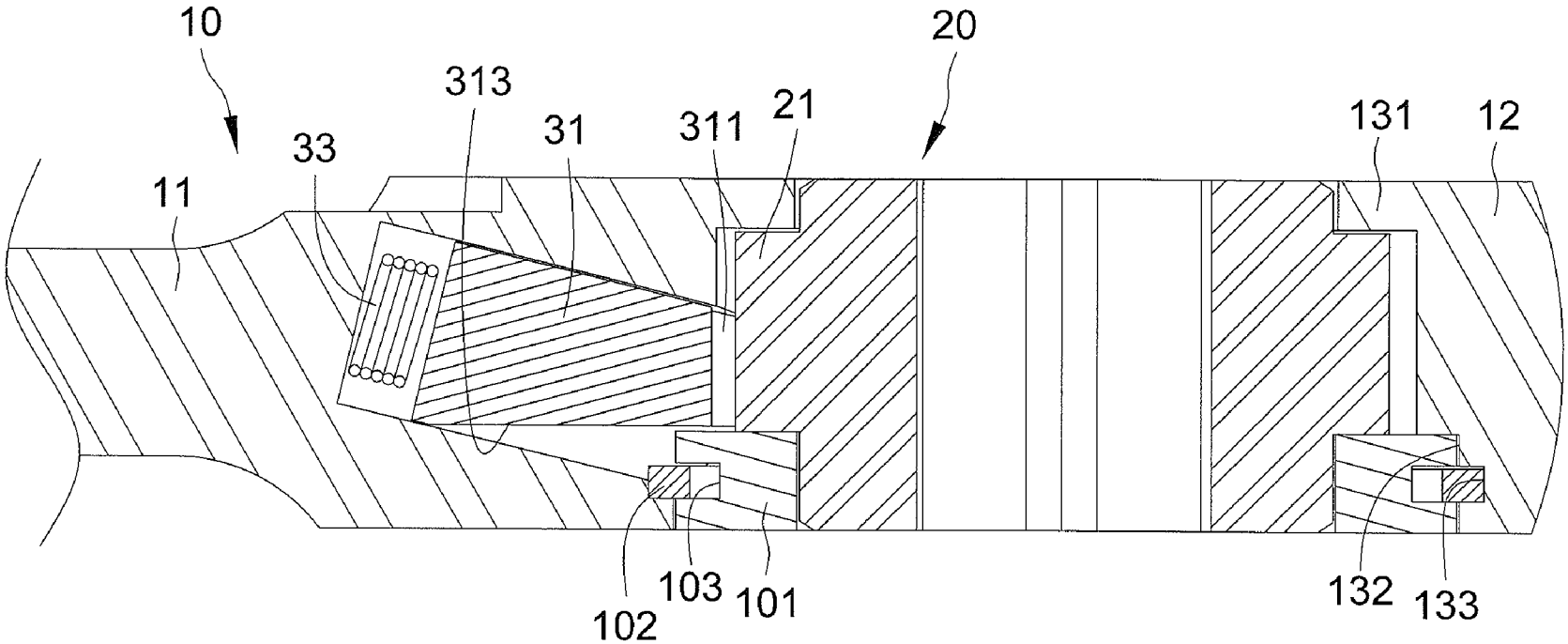
FIG. 7 is a cross-sectional view of the ratchet wrench embodying the present invention taken along line 7-7 of FIG. 5.
Figure 8:
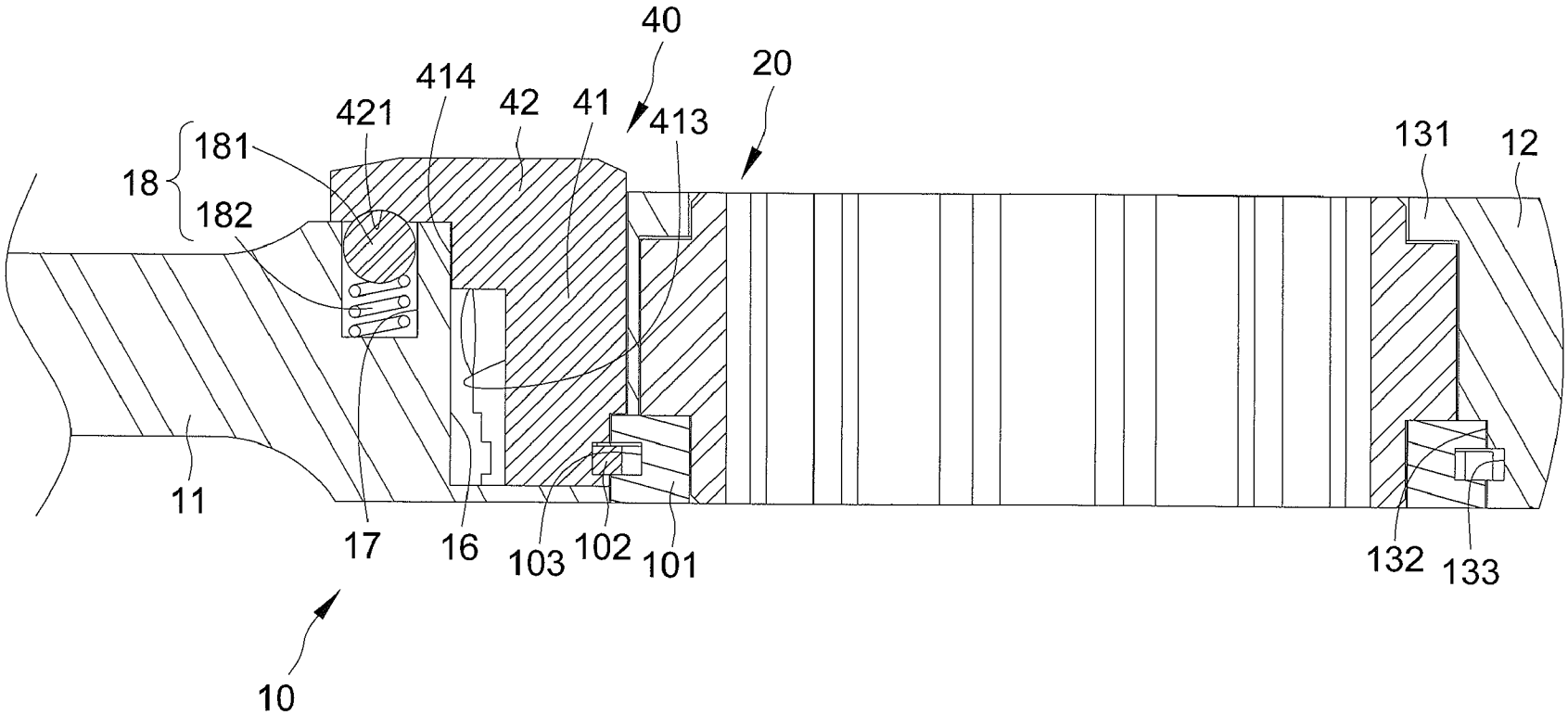
FIG. 8 is a cross-sectional view of the ratchet wrench embodying the present invention taken along line 8-8 of FIG. 4.
Figure 9:
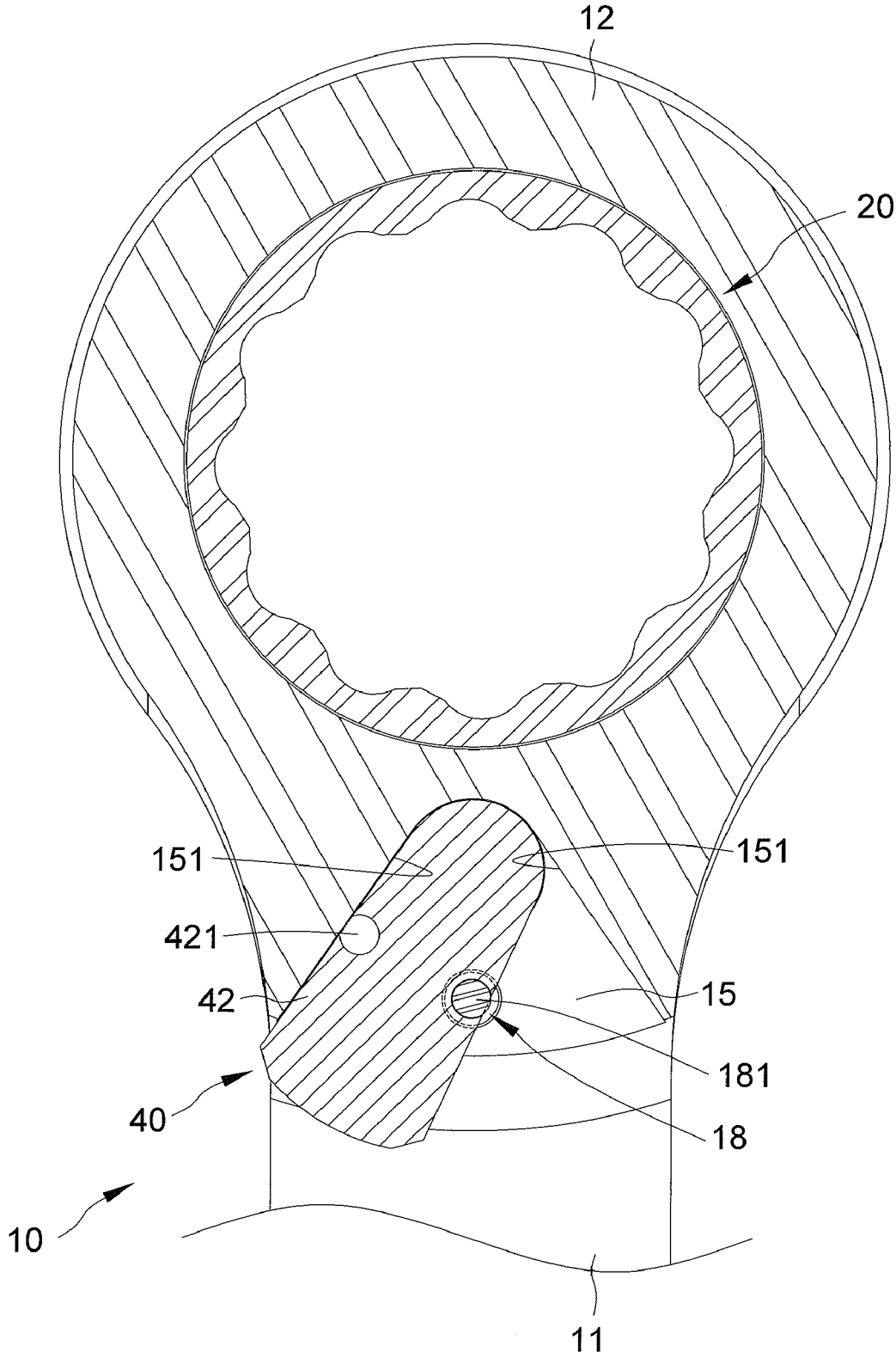
FIG. 9 is an extended view of FIG. 4 illustrating a switch of the ratchet wrench in another position, and with the ratchet wrench being set in another operation mode.

In addition, the body 41 of the switching mechanism 40 prevents each of the pawls 31 from mis-shifting, i.e. each of the pawls 31 is liable to rotate about its longitudinal axis when being operated to selectively engage with the ratchet member 20. The body 41 includes a holding section 414 limiting the lateral sides 312 of the pawls 31, as shown in FIG. 6. The holding section 414 preferably includes a first portion with a circular cross section and a second portion cooperating with the urging section 413 to form a semi-circular cross section. Additionally, the first and second portions both have curvatures conforming with that of the hole 16, since this design facilitates the manufacturing thereof and would be cost-saving.

The switching mechanism 40 further includes a control arm 42 facilitating operation of the body 41. The control arm 42 extends from the body 41 and is disposed outside the hole 16 and above the first side 121 of the driving end 12. In addition, the control arm 42 is cooperated with a positioning device 18 to enable the body 41 to urge the pawl 31 that is to be disengaged from the ratchet member 20 continuously. The positioning device 18 includes a detent 181 disposed in a hole 17 extending in the driving end 12 and which selectively engages with two locking sections 421 formed on the control arm 42 such that the detent 181 is partially engaged in one locking section 421 and is partially engaged in the hole 17 to urge one pawl 31 to disengage from the ratchet member 20 in one operation mode, and the detent 181 is partially engaged in the other locking section 421 and is partially engaged in the hole 17 to urge the other pawl 31 to disengage from the ratchet member 20 in another operation mode. Furthermore, the control arm 42 includes two opposing sides including an upper side and a lower side, and the locking sections 421 are formed on the lower side. The lower side is preferably flat and the locking sections 421 are preferably recesses inset in the lower side so that it is easy to manufacture and would be cost-saving. Therefore, the detent 181 would be urged toward the hole 17 by the lower side of the control arm 42 if it is disengaged from the locking sections 421. Furthermore, the detent 181 is preferably solid and is non-deformable in order to secure the control arm 42 and consequently the body 41 in place. Thus, the detent 181 needs a force to assist it to engage in the locking sections 421. In this regard, the positioning device 18 includes a resilient member 182 disposed in the hole 17 which biases the detent 181. Furthermore, the first side 121 of the driving end 12 includes a cutout 15 in which the control arm 42 is disposed. Moreover, the holes 16 and 17 aforementioned extend in a side of the cutout 15 formed in the driving end 12. Additionally, the cutout 15 includes a stopping wall 151 extending substantially orthogonally to that side. The control arm 42 has one lateral side abutting against one side of the stopping wall 151 when the detent 181 engages with one locking section 421 and has another lateral side abutting against another side of the stopping wall 151 when the detent 181 engages with the other locking section 421.

Each pawl 31 further includes a lateral side 313 extending in a first path from the proximal end to the distal end, and the lateral side 313 has one end supported by the peripheral edge of the associated cavity 14 and the other end supported by the retainer 101. In addition, the lateral side 313, ratchet member 20 and/or the retainer 101, and the peripheral edge of the associated cavity 14 define a substantially triangular space therebetween in order for the pawl 31 to move in the associated cavity 14.

In view of forgoing, since the body 41 of the switching mechanism 40 prevents each of the pawls 31 from mis-shifting, i.e. each pawl 31 is liable to rotate about its longitudinal axis when being operated to selectively engage with the ratchet member 20, the ratchet wrench is not subject to a teeth breakage problem. In addition, engagement between each of the pawls 31 and the ratchet member 20 is in an ideal manner. Therefore, the ratchet wrench is usable for withstanding a large torque operational force.

While the specific embodiments have been illustrated and described, numerous modifications come to mind without significantly departing from the spirit of invention, and the scope of invention is only limited by the scope of the accompanying claims.

What is claimed is:

1. A ratchet wrench comprising:

a driving end, wherein the driving end includes a compartment extending therethrough, wherein the driving end includes two cavities extending therein and which are spaced from each other, wherein each cavity extends orthogonally to and connected with the compartment;

a ratchet member rotatable received in the driving end, with the ratchet member received in the compartment, wherein the ratchet member includes an orifice in which a workpiece to be driven is adapted to be inserted and retained therein;

two pawl mechanisms releasably engaging with the ratchet member, wherein the two pawl mechanisms are disposed in the two cavities respectively, with each of the two pawl mechanisms moving toward and away from the ratchet member in a moving path; and a switching mechanism disposed between the two pawl mechanisms and which includes a body including an urging section defining limits selectively urging the pawl mechanisms such that one limit engages with one pawl mechanism to urge the one pawl mechanism to disengage from the ratchet member while the other limit disengages from the other pawl mechanism to allow the other pawl mechanism to engage with the ratchet member in a first operation mode, and the other limit engages with the other pawl mechanism to urge the other pawl mechanism to disengage from the ratchet member while the one limit disengages from the one pawl mechanism to allow the other pawl mechanism to engage with the ratchet member in a second operation mode, with the body further including a holding section abutting both pawl mechanisms and preventing each of the two pawl mechanisms from rotating about the moving path, wherein the two pawl mechanisms alternatively engage with the ratchet member and stop the ratchet member from rotating in a direction that the ratchet wrench is intended to be turned, wherein each pawl mechanism includes a pawl, wherein the pawl of one pawl mechanism engages with the ratchet member while the pawl of the other pawl mechanism disengages from the ratchet member, wherein each pawl includes a lateral side extending longitudinally, wherein the lateral side, the ratchet member and a peripheral edge of the associated cavity define a space therebetween in order to allow the pawl to move in the associated cavity, and wherein the space has a triangular shape.

2. The ratchet wrench as claimed in claim 1 wherein the orifice has a polygonal cross section, and wherein the ratchet member includes an inner peripheral edge delimiting a size of the orifice, and wherein the ratchet member includes an outer peripheral edge including a plurality of teeth formed thereon.

3. The ratchet wrench as claimed in claim 2 wherein each of the plurality of teeth extends parallel to one another and in a direction as that of the orifice.

4. The ratchet wrench as claimed in claim 1 wherein the ratchet member is prevented from disengagement from the compartment by a flange formed from the driving end and a retainer which is insertably mounted in the compartment after the ratchet member is disposed in the compartment.

5. The ratchet wrench as claimed in claim 4 further comprising a clip fixing and preventing the retainer from disengagement from the compartment.

6. The ratchet wrench as claimed in claim 5 wherein the compartment includes a recess extending annularly and disposed adjacent to a second side of the driving end, and wherein the retainer includes an outer peripheral edge having a groove extending therealong, and wherein the recess includes a channel formed theron, and wherein the clip includes an inner peripheral edge disposed in the groove and an outer peripheral edge disposed in the channel.

7. The ratchet wrench as claimed in claim 1 wherein the driving end includes a hole extending therein, wherein the body of the switching mechanism is rotatably fixed in the hole, and wherein the hole and each cavity include a common area defined therebetween.

8. The ratchet wrench as claimed in claim 1 wherein the limits are defined at two opposing ends of the urging section, and wherein the urging section is a flat surface.

9. The ratchet wrench as claimed in claim 1 wherein the holding section includes a first portion with a circular cross section and a second portion cooperating with the urging section to form a semi-circular cross section.

10. The ratchet wrench as claimed in claim 1 wherein the switching mechanism includes a control arm extending from the body to facilitate operation of the body, and wherein the control arm is cooperated with a positioning device to enable the body to urge the pawl mechanism that is to be disengaged from the ratchet member continuously.

11. A ratchet wrench comprising:

a driving end, wherein the driving end includes a compartment extending therethrough, wherein the driving end includes two cavities extending therein and which are spaced from each other, wherein each cavity extends orthogonally to and connected with the compartment;

a ratchet member rotatably received in the driving end, with the ratchet member received in the compartment, wherein the ratchet member includes an orifice in which a workpiece to be driven is adapted to be inserted and retained therein;

two pawl mechanisms releasably engaging with the ratchet member, wherein the two pawl mechanisms are disposed in the two cavities respectively, with each of the two pawl mechanisms moving toward and away from the ratchet member in a moving path;

a switching mechanism disposed between the two pawl mechanisms and which includes a body including an urging section defining limits selectively urging the pawl mechanisms such that one limit engages with one pawl mechanism to urge the one pawl mechanism to disengage from the ratchet member while the other limit disengages from the other pawl mechanism to allow the other pawl mechanism to engage with the ratchet member in a first operation mode, and the other limit engages with the other pawl mechanism to urge the other pawl mechanism to disengage from the ratchet member while the one limit disengages from the one pawl mechanism to allow the other pawl mechanism to engage with the ratchet member in a second operation mode, with the body further including a holding section abutting both pawl mechanisms and preventing each of the two pawl mechanisms from rotating about the moving path, wherein the driving end includes a hole extending therein, wherein the body of the switching mechanism is rotatably fixed in the hole, wherein the hole and each cavity include a common area defined therebetween, wherein the hole includes a terminating end connected with the compartment; and a clip partially extends in the hole to prevent the body from disengagement from the hole.

12. The ratchet wrench as claimed in claim 11 wherein each cavity includes a lateral wall having a cross section defining a slope.

13. The ratchet wrench as claimed in claim 12 wherein the two pawl mechanisms alternatively engage with the ratchet member and stop the ratchet member from rotating in a direction that the ratchet wrench is intended to be turned.

14. The ratchet wrench as claimed in claim 13 wherein each pawl mechanism includes a pawl, and wherein the pawl of one pawl mechanism engages with the ratchet member while the pawl of the other pawl mechanism disengages from the ratchet member.

15. The ratchet wrench as claimed in claim 14 wherein each pawl mechanism includes a resilient member biasing the pawl.

16. The ratchet wrench as claimed in claim 14 wherein each pawl includes a first lateral side extending longitudinally and a stopping section to be urged by the associated limit to disengage the pawl from the ratchet member, and wherein the lateral side is a flat surface, and wherein the stopping section extends in a path crossing a path the lateral side extends.

17. The ratchet wrench as claimed in claim 14 wherein each pawl includes a lateral side extending longitudinally, and wherein the lateral side, the ratchet member and a peripheral edge of the associated cavity define a space therebetween in order to allow the pawl to move in the associated cavity.

18. The ratchet wrench as claimed in claim 11 wherein the limits are defined at two opposing ends of the urging section, and wherein the urging section is a flat surface.

19. The ratchet wrench as claimed in claim 11 wherein the holding section includes a first portion with a circular cross section and a second portion cooperating with the urging section to form a semi-circular cross section.

20. The ratchet wrench as claimed in claim 11 wherein the switching mechanism includes a control arm extending from the body to facilitate operation of the body, and wherein the control arm is cooperated with a positioning device to enable the body to urge the pawl mechanism that is to be disengaged from the ratchet member continuously.

* * * * *